US006073306A

United States Patent [19]

Warren et al.

[11] Patent Number: 6,073,306

[45] **Date of Patent: *Jun. 13, 2000**

[54] SAFETY DEVICE

[76] Inventors: Andrew Warren, 86 Derwent Road, Palmers Cross, Tettenhall, West Midlands WV6 9ET, United Kingdom; Desmond Corbett, Sunnyside Station Road, Haughton, Stafford, ST18 9HJ, United Kingdom

[ * ] Notice: This patent is subject to a terminal disclaimer.

[21] Appl. No.: 08/969,327

[22] Filed: Nov. 13, 1997

Related U.S. Application Data

[62] Division of application No. 08/557,014, filed as application No. PCT/GB94/01238, Jun. 8, 1994, Pat. No. 5,749,123.

[30] Foreign Application Priority Data

Jun. 10, 1993 [GB] United Kingdom ..... 9311982
Mar. 17, 1994 [GB] United Kingdom ..... 9405239

[51] Int. Cl.[7] ..... E05F 5/04

[52] U.S. Cl. ..... 16/86 R; 16/82

[58] Field of Search ..... 16/72, 75, 76, 16/80, 82, 83, 86 A, 86 B, 86 C, 86 R

[56] References Cited

U.S. PATENT DOCUMENTS 3,335,453 8/1967 Lovelace ..... 16/82
4,028,772 6/1977 Salerno ..... 16/83
4,982,474 1/1991 Kjellström ..... 16/82

FOREIGN PATENT DOCUMENTS 737814 12/1932 France ..... 16/83
2110636 6/1972 France ..... 16/83

*Primary Examiner*—Chuck Y. Mah
*Assistant Examiner*—Donald M. Gurley
*Attorney, Agent, or Firm*—James B. Middleton

[57] ABSTRACT

The invention relates to a safety device, and in particular to a safety device for a sliding panel, such as a patio door.

The safety device includes an abutment, a carrier member for the abutment, a mounting arm for the carrier member, a pivot for the mounting arm, the pivot axis being substantially parallel to the carrier member, a support for the pivot, a resilient bias spring urging the mounting arm towards an abutment condition, the resilient bias spring being connected between the mounting arm and the support, and a manually operable member for moving the abutment against said resilient bias spring, the manually operable member comprising finger grip elements carried by the mounting arm, the finger grip elements being spaced from the pivot.

12 Claims, 2 Drawing Sheets

SAFETY DEVICE

This application is a divisional application of the co-pending application of the same inventors, filed Dec. 7, 1995, under application Ser. No. 08/557,014, issued on May 12, 1998, as U.S. Pat. No. 5,749,123 which is a 371 of PCT/GB94/01238, filed Jun. 8, 1994.

FIELD OF THE INVENTION

This invention relates to a safety device, and in particular to a safety device for a sliding panel, such as a patio door.

BACKGROUND TO THE INVENTION

When not in use, sliding panels (particularly if external to the building, such as patio doors) need to be lockable for security. However, for ease of use, when unlocked they are made so as to be freely slidable in their surrounding framework.

During closing of a patio door, any person interposing for instance their hand or fingers between the leading edge(s) or leading edge surface of the door and the closure jamb of the framework can be seriously injured; it is known that such fingertip injuries are most commonly suffered by children, typically either acting alone or when an adult has inadvertently or accidentally quickly closed the door.

The door lock mechanism is typically face-mounted on the door leading edge, and comprises an espagnolette with mushroom headed security bolts intended to engage behind narrowed portions of keyhole slots in the closure jamb; inquisitive children in particular are known to interfere with and misuse the lock and then to seek to close the door with the mushroom headed security bolts already in the locked position, so damaging the locking mechanism in whole or in part, and affecting the security offered by the door.

DESCRIPTION OF THE PRIOR ART

A safety device already proposed for sliding doors is shown in FIG. 1. A deformable ball (preferably resilient) is spring-biased, normally against an inward face of a closed door and in such position that upon door opening the ball can automatically pivot into an abutment position between the leading edge surface of the door and the closure jamb of its framework, whereby to prevent door closure. The ball of the proposed safety device is mounted on a rod having (in its position of use) a vertical portion of considerable length, the vertical portion carrying at its lower end a knurled knob which can be gripped to rotate the rod whereby to move the ball out of the pathway of the closing door i.e. away from the abutment position. However, even when the safety device is mounted at the top of the framework closure jamb, because of the vertical rod portion the knob can be reached and turned by all but the smallest children who can then "de-activate" the safety device; this could occur even though the rod could be difficult to turn from its lower end because of the limited space between the knob and housing mounting. Alternatively considered, the need to turn the lower end of the rod determines the minimum acceptable thickness of the housing projecting into the room or building, perhaps into the path of a curtain or the like, and with sharp edges and corners (dangerous unless above head-height). The housing is shown as closed on all sides and would appear therefore difficult to mount. The rod is loosely retained (in a closed housing apparently of significant length and weight). The device is "handed" so that two designs need to be made, assembled and stocked, one for each opposed panel closure end, and each with a differently wound spring. Fitting a spring onto the rod appears complicated. The ball is non-rotatably mounted upon the rod, and so may mark the inward face of the sliding panel and/or may become scuffed thereby.

STATEMENT OF THE INVENTION

According to one feature of the invention we provide a safety device which includes an abutment means, carrier means for the abutment means, a mounting arm for the carrier means, pivot means for the mounting arm, support means for the pivot means, resilient bias means urging the mounting arm towards an abutment condition, the resilient bias means being connected between the mounting arm and the support means, and manually operable means for moving the abutment means against said resilient bias, characterised in that carrier means is substantially parallel to the pivot means.

We also provide a safety device for a panel which is slidably mounted in a framework for engagement of a panel leading edge with a framework closure jamb, which includes a deformable abutment means biased by resilient means towards a first condition between the leading edge of an opened panel and the framework closure jamb, a mounting arm for the abutment means, pivot means for the mounting arm, support means for the pivot and manually operable means to move the abutment means against said resilient means characterised in that the support means is located alongside said abutment means.

In a preferred embodiment the panel has an inwardly facing internal face and a leading edge which are both substantially planar, the pivot means having its axis parallel both to the plane of the internal face and that of the leading edge.

In another preferred embodiment, the housing and mounting arm are formed to provide aligned retention means for a retainer adapted to hold the abutment means away from said internal face i.e. in an inoperative condition. In a desired embodiment the retainer is removable, and in another desired embodiment the retainer, when not required, may be stored within an aperture of the device.

In a further preferred embodiment, the support means includes stop means to limit movement of the mounting arm against the resilient bias, whereby to prevent overstressing of the resilient bias means, which is conveniently a torsion spring.

Usefully the mounting arm is bifurcated, to hold an abutment roller therebetween; desirably the roller is rotatable, whereby to present different areas for the abutment function.

Additionally, we provide an assembly comprising a framework, a panel slidable mounted in the framweork for engagement of a panel leading edge with a framework closure jamb, and a safety device according to any of claims 1–9 mounted to the panel so that in said abutment condition the abutment means is between the panel leading edge and the framework closure jamb.

BRIEF DESCRIPTION OF THE DRAWINGS

The invention will be further described, by way of example, with reference to the accompanying drawings, in which.

DETAILED DESCRIPTION OF THE PREFERRED EMBODIMENTS

Figure 1:
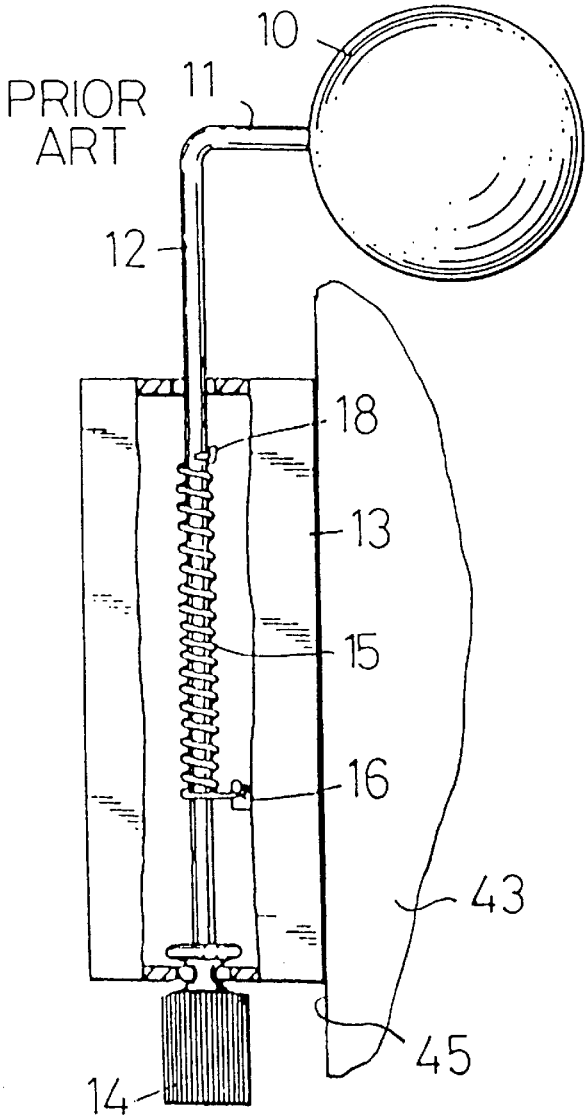
FIG. 1 is a schematic view of a known safety device for a slidable panel.
Figure 4:
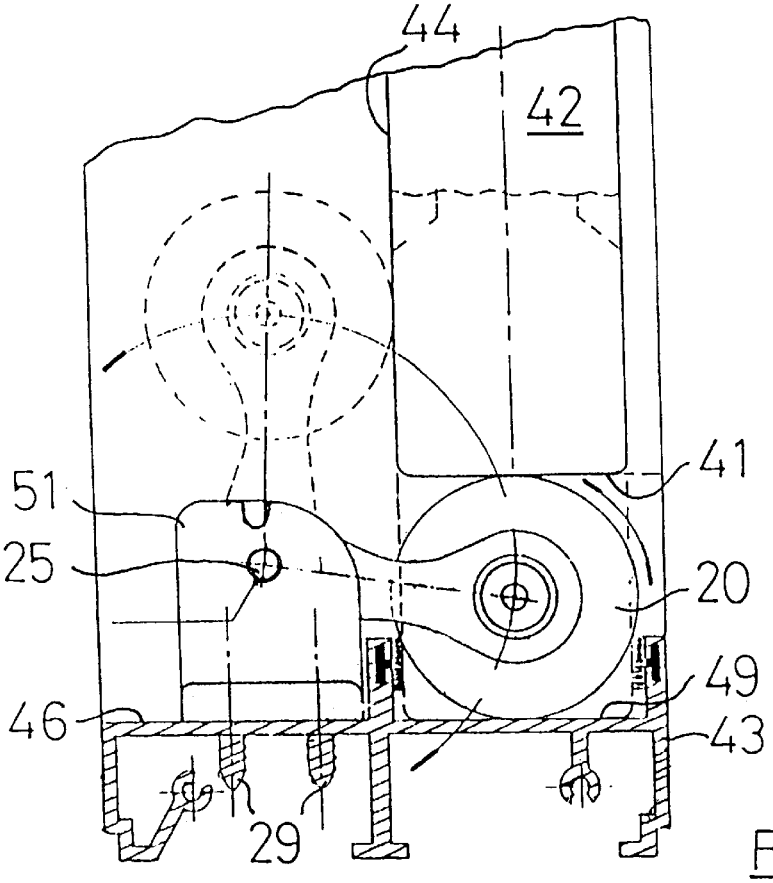
FIG. 4 is a plan view of the embodiment of FIG. 3, with the abutment trapped between a slidable window door leading edge and a framework closure jamb; and also showing in dotted outline the abutment resting against the internal face of the panel.

In the prior art embodiment of FIG. 1, a resilient ball 10 is carried by a rod 11. Rod 11 is integral with a perpendicular rod portion 12. Rod portion 12 extends downwardly through a housing 13 and terminates in knurled finger grip 14 adapted to permit the ball 10 to be turned from its abutment condition shown i.e. for an embodiment as seen in FIG. 4 "trapped" between a leading edge 41 of a panel 42 and the associated closure jamb 49 of a surrounding framework member 43, towards a non-abutment condition. Rod portion 12 and thus ball 10 is loosely mounted in housing 13. Ball 10 is resiliently biassed towards its abutment condition by torsion spring 15 which is connected at its end 16 to housing 13 and at its end 18 to rod portion 12; when the panel is in its closed condition, the ball can rest non-rotatably against the slidable panel e.g. the glazing or its surround, as indicated also but rotatably for the arrangement of the invention (in dotted outline, FIG. 4).

In use, the prior art housing 13 is intended to be secured to an internal face 45 of the closure stile 43, face 45 being in a plane substantially parallel to that of the internal panel face 44 (FIG. 4).

In an arrangement according to the invention the abutment means is a cylindrical roller 20, of a resilient material able to provide shock absorption and noise limitation if the panel e.g. window door (patio door), with which it is to act is moved too quickly towards the closed i.e. abutment condition; roller 20 is mounted on a pin 21, as more fully described below. Pin 21 acts therefor as a carrier means for roller 20.

In the embodiment shown the roller 20 can rotate about the pin 21, so as to provide a continually changing abutment surface whereby to spread the wear and increase the life of the roller; in a first alternative embodiment the roller can rotate with pin 21. An advantage of a rotatable roller or the like is that the panel face 44 (glazing or surround) is less likely to be marked i.e. less likely to slide as it moves in face contact with the roller (as shown in dotted outline in FIG. 4). In another alternative embodiment the roller 20 is spherical rather than cylindrical. We do not however discount that in yet a further but much less preferred alternative embodiment the roller 20 is "speared" by pin 21 (as in the prior art embodiment of FIG. 1), with the roller 20 non-rotatably attached to pin 21, with pin 21 non-rotatably mounted to mounting arm 22.

Figure 3:
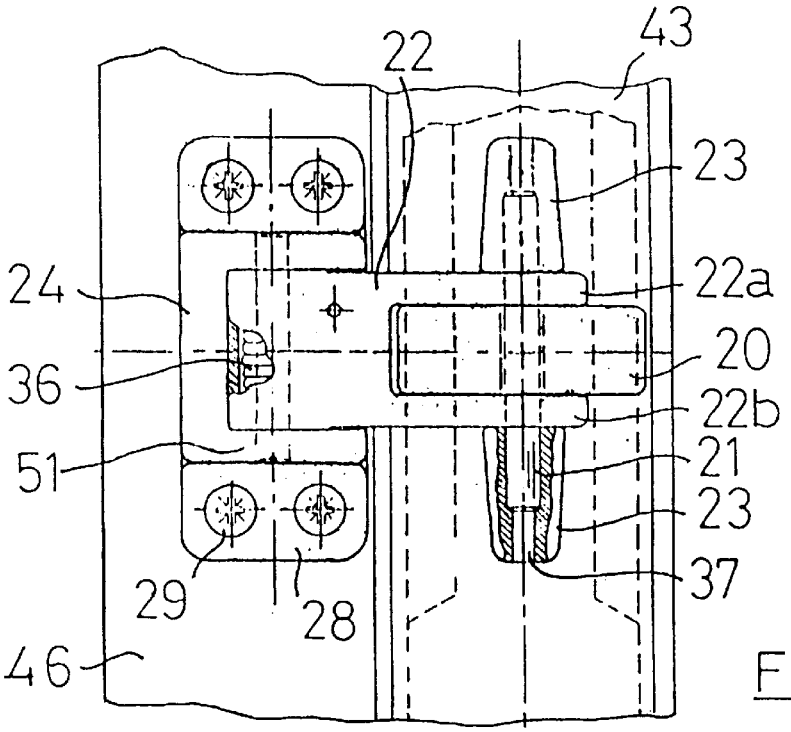
FIG. 3 is a view corresponding to that of FIG. 1, but of an embodiment of the invention mounted to the jamb of a slidable panel framework.

Thus, in its installed position (FIG. 3) pin 21 is substantially vertical, carried by the mounting arm 22 which is bifurcated to provide spaced arm sections 22*a*,22*b* between which pin 21 extends, non-rotatably. In another embodiment, the pin 21 is rotatable with the roller 20. In yet another embodiment, a bush is provided between the (non-rotatable) pin and the roller, so that the roller is not caused to wear excessively as it rotates about the pin.

Secured to each end of pin 21 is a finger grip 23, by means of either or both of which the pin 21 and thus the mounting arm 22 can be moved (out of the paper as viewed for FIG. 3) about pivot pin 25 (FIG. 4) against the bias of torsion spring 36. The safety device is thus non-handed, and can be used for slidable panels which close either against a left-hand framework jamb or against a right-hand framework jamb (or upper and lower framework members for vertically closing i.e. sash windows).

Thus the window can be closed with one hand, whilst the roller 20 is held out of the closure path of the window (or other slidable panel) with the other.

The pin 21 is in this embodiment a tubular split pin, onto which the finger grips 23 are pressed so as to be gripped frictionally, whereby to allow removal and replacement of the roller 20 should this become worn. Thus one or both finger grips 23 would first be removed, then pin 21 would be removed as by hand or with an appropriate tool i.e. from the arm sections 22*a*,22*b*.

In a first alternative embodiment a first finger grip is permanently fixed to one end of the pin, and the second finger grip is releasable from the other end of the pin, perhaps being a press fit thereupon as with the pin 20 and finger grip 23 of the drawings; in a less preferred alternative embodiment, the second fingergrip is permanently secured to the pin following assembly of the device, as by adhesive.

In a second alternative embodiment, both of the finger grips are integral with the pin, and the pin has circumferential grooves to accept circlips or the like, by which the pin and finger unit may be releasably secured to the mounting arm.

The support member 24 for pivot pin 25 is secured at flanges 28 by "cross-head" screws 29 against a sideways facing surface 46 of the framework closure jamb 43; in this preferred position the fitted support member can be out of the path of a window curtain or blind. In an alternative embodiment a cover may be provided to obscure the heads of the screws 29.

In this embodiment surface 46 is planar. However, different manufacturers are known to provide panel frameworks with different external profiles e.g. a differently shaped surface 46, which may include ridges and/or recesses, and less often may be slightly curved. The support member 24 and flanges 28 can be correspondingly shaped, for instance with suitable co-operating recesses, projections or curvature, which then can act to assist in the location of the support member. Alternatively a packing piece suited to a proprietary framework external profile (surface 46 or equivalent) can be used, permitting not only a common design of support member 24, but also the possible advantage of spacing pivot 25 further from the profile whereby to permit the mounting arm 22 in its operative position to clear a framework profile intermediate upstand such as the one shown in FIG. 4.

For an alternative installation, with the support member 24 needing to be connected to an inwards facing framework closure jamb surface, as for the prior art arrangement of FIG. 1, then the support member 24 can be mounted to a intermediate bracket (not shown).

Figure 5:
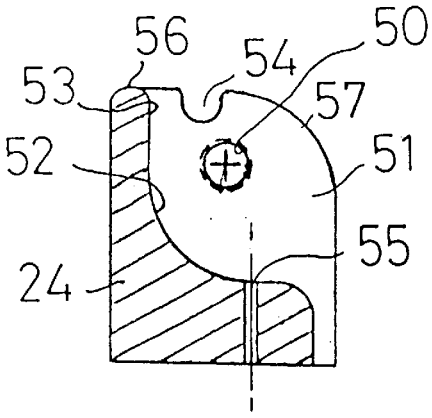
FIG. 5 is a mid-section through the support means of FIG. 4.

The pivot pin 25 in this preferred embodiment is a tubular split pin, of a size so that it can be fed through aligned openings 50 in spaced walls 51 of the support member 24 (FIG. 5). In another embodiment the pivot pin is solid; in yet another embodiment the pivot pin is hollow, but not split.

Figure 6:
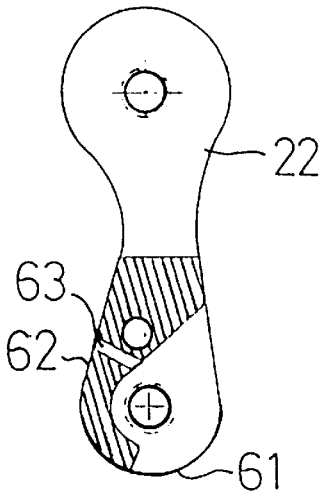
FIG. 6 is a mid-section through the mounting arm of FIG. 4.

The support member 24 has a cammed formation 52 (FIG. 5) which can engage a complementary formation 61 (FIG. 6)

on the mounting arm 22, to limit clockwise movement (as viewed in FIGS. 2 and 5) of the mounting arm 22 to an angular position just beyond the operating position of the mounting arm 22 as shown in FIG. 4. Thus when fitted, as in the FIG. 4 showing, the roller 20 is positively biassed by the torsion spring into engagement with the abutment surface 49, to limit impact loading of this surface as the slidable panel is moved towards closure; however, prior to installation, the mounting arm 22 and roller 20 adopt a convenient position at a more acute angle relative to spaced walls 51, i.e slightly further clockwise than as seen in FIG. 4.

The edges 56,57 of the support member remote from flanges 28 are rounded, for increased safety should the device be mounted (against advice) at or below head-height.

The mounting arm 22 also has a limit surface 62 (FIG. 6) which can engage edge 53 (FIG. 5) of support member 24 to limit anti-clockwise pivoting movement of the mounting arm 22, to prevent full or near full wind-up of the spring 36.

Figure 2:
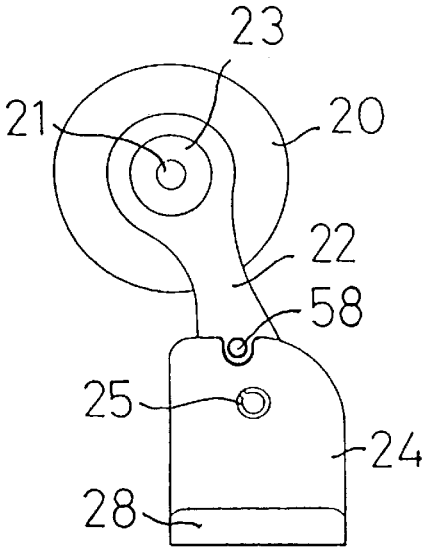
FIG. 2 is a plan view of a safety device according to the invention, with the abutment held in its inoperative condition.

In a preferred arrangement, and as illustrated in FIG. 5, the walls 51 also each have a recess 54 in which can rest a, retaining member for the mounting arm 22, in this embodiment a peg 58 (FIG. 2); in use the peg 58 engages the recesses 54, and passes through an aligned aperture in the arm 22, and then acts to hold the mounting arm 22 in the position shown in FIG. 2 spaced away from (i.e. out of contact with) the internal face 44 of the sliding panel. This is the inoperative position of the abutment (roller 20), useful if the patio door or window is either not to be opened for a long period, and when otherwise the abutment might take a permanent compression set or when the device is in use on a slidable panel which is in a building external wall and which is locked from the outside. In such a case the mounting arm 22 may be secured back (in its inoperative condition) by the peg 58 i.e. before the user moves to the outside of the building, avoiding the difficult and potentially dangerous need to move the roller out of an abutment position from outside the building, as by the user interposing his hand between the door and framework.

In an alternative embodiment the walls 51 have a through-aperture and the mounting arm has an aperture which can be aligned therewith. In a further alternative embodiment only one wall has a recess or aperture respectively, the other having a closed end slot or no retention means i.e. the peg 58 is in cantilever.

The peg 58, when not required to retain the mounting arm 22, can be fitted into one or other aperture 37 formed or provided in the end of each finger grip 23; alternatively it can be fitted into the pivot pin 25.

The mounting arm is resiliently biassed (clockwise) towards the FIG. 4 conditions (dotted line and then full line) by torsion spring 36 located between walls 51. As seen in FIG. 5, one of the walls has an aperture 55 to receive one end of spring 36; the other end of the spring 36 is received in an aperture 63 (FIG. 6) in the mounting arm 22. In an alternative embodiment one or both of the apertures are blind. The intermediate coils of torsion spring 36 (loosely) surround part of pivot pin 25.

We have thus provided a safety device of great utility, easy to fit to existing and new sliding panels alike, at positions (recommended to be above head height) selected to be out of normal reach of the irresponsible; the design has provision to avoid overstressing and over-stretching of the spring, permits easy replacement of the spring as and when necessary, permits easy replacement of the preferred embodiment of abutment roller as required, is suited without modification to many different known proprietary window door framework closing jamb and door lock stile profiles and is of compact size and relatively light weight, e.g. suitable for glazed, aluminium-framed slidable doors. It will be understood that the device will also be suitable for non-glazed, or solid, panels, and for panels of wood or plastics, such as PVC.

Finger injuries in particular arising from trapping the hand between a closing door and a frame part are significant in number, though this number will we believe be reduced by the widespread application of our device.

We claim:

1. A safety device which includes an abutment means, a pin extending through said abutment means and constituting carrier means carrying the abutment means, a mounting arm carrying the carrier means, pivot means carrying the mounting arm, the pivot means being substantially parallel to the carrier means, support means supporting the pivot means, resilient bias means urging the mounting arm towards an abutment condition, the resilient bias means being connected between the mounting arm and the support means, and manually operable means for moving the abutment means against said resilient bias, the manually operable means comprising finger grip means carried by the mounting arm, the finger grip means being spaced from the pivot means and adjacent to said carrier means.

2. A safety device according to claim 1 in which the carrier means is selectively removable from the mounting arm.

3. A safety device according to claim 1 in which the pin is a tubular split pin.

4. A safety device according to claim 1 in which retaining means are provided to hold the abutment means in an inoperative position, the retaining means being locatable within one of the finger grips when not in use.

5. A safety device according to claim 1 in which the abutment means is of resiliently deformable material.

6. A safety device according to claim 1 in which the abutment means is substantially circular and is mounted to rotate about said carrier means as an axis of rotation, the finger grips being substantially coaxial with the said axis of rotation.

7. A safety device which includes an abutment means, a pin extending through said abutment means and constituting carrier means carrying the abutment means, a mounting arm carrying the carrier means, pivot means carrying the mounting arm, the pivot means being substantially parallel to the carrier means, support means supporting the pivot means, resilient bias means urging the mounting arm towards an abutment condition, the resilient bias means being connected between the mounting arm and the support means, and manually operable means to move the abutment means against said resilient bias means, the manually operable means comprising a pair of finger grips adjacent to said carrier means which project in opposed directions from the mounting arm away from the abutment means.

8. A safety device according to claim 7 in which the finger grips are mounted upon the carrier means.

9. A safety device according to claim 7 in which the mounting arm includes a pair of arm sections mounting the carrier means therebetween.

10. A safety device according to claim 9 in which the carrier means has opposed extensions protruding from the mounting arm sections, each of the protruding extensions carrying a finger grip.

11. A safety device according to claim 7 in which at least one of the finger grips is removably mounted upon the carrier means.

12. An assembly comprising a framework, a panel having a leading edge, the panel being slidably mounted in the framework for engagement of the panel leading edge with a framework closure jamb, and a safety device according to claim 7 mounted to the framework so that in said abutment condition the abutment means is between the panel leading edge and the framework closure jamb.

* * * * *